US006637596B1

(12) United States Patent
Ito et al.

(10) Patent No.: US 6,637,596 B1
(45) Date of Patent: Oct. 28, 2003

(54) PRESS-THROUGH PACK, SEALING SHEET FOR PRESS-THROUGH PACK, AND PREPARATION METHOD OF TABLET

(75) Inventors: Kunio Ito, Shizuoka (JP); Eiji Hayakawa, Shizuoka (JP); Shigemitsu Miura, Susono (JP); Junichi Miyabe, Susono (JP); Toshiyuki Oota, Osaka (JP); Yoichiro Yotsuya, Osaka (JP)

(73) Assignee: Kyowa Hakko Kogyo Co., Ltd., Tokyo (JP)

( * ) Notice: Subject to any disclaimer, the term of this patent is extended or adjusted under 35 U.S.C. 154(b) by 0 days.

(21) Appl. No.: 09/539,701

(22) Filed: Mar. 31, 2000

Related U.S. Application Data

(63) Continuation of application No. PCT/JP98/04452, filed on Oct. 1, 1998.

(30) Foreign Application Priority Data

Oct. 2, 1997 (JP) ..... 9-269845

(51) Int. Cl.[7] ..... B65D 83/04
(52) U.S. Cl. ..... 206/530; 206/539
(58) Field of Search ..... 206/528, 530, 206/531, 532, 534, 534.1, 534.2, 538, 539, 460

(56) References Cited

U.S. PATENT DOCUMENTS

| | | | | | |
|---|---|---|---|---|---|
| 2,386,416 | A | * | 10/1945 | Wilhelm | 206/531 |
| 3,924,746 | A | * | 12/1975 | Haines | 206/530 |
| 3,924,748 | A | * | 12/1975 | Braverman | 206/534.1 |
| 4,158,411 | A | * | 6/1979 | Hall et al. | 206/531 |
| 5,172,812 | A | * | 12/1992 | Wharton et al. | 206/531 |
| 5,318,824 | A | * | 6/1994 | Itaya et al. | 206/531 |
| 5,360,116 | A | * | 11/1994 | Schmiletzky | 206/531 |
| 5,486,390 | A | * | 1/1996 | Burns et al. | 206/531 |
| 5,624,036 | A | | 4/1997 | Roulin et al. | |
| 5,785,180 | A | * | 7/1998 | Dressel et al. | 206/532 |

FOREIGN PATENT DOCUMENTS

| | | |
|---|---|---|
| DE | 35 32 257 | 3/1987 |
| EP | 0 570 188 | 7/2002 |

* cited by examiner

*Primary Examiner*—Luan K. Bui
(74) *Attorney, Agent, or Firm*—Fitzpatrick, Cella, Harper & Scinto

(57) ABSTRACT

A press-through pack and a sealing sheet for use in the same capable of easily taking out solid material such as tablet or the like contained storage recesses by only pushing action of fingers. The pack comprises an accommodation body (2) with plural storage recesses (2*a*) defined by sheet like portions (2*b*) for a containing solid material therein and sealing sheet (5). The sealing sheet (5) is made of such material that a recess (2*a*) in which solid material (T) contained, is partly ruptured without causing floating and peeling at the adhesion portion of the adhesive layer (4) and the sheet like portions (2*b*) when pushing the projecting portion (2*c*) of the outer side of the recess (2*a*) with fingers, whereby the solid material (T) contained in the recess (2*a*) is easily taken out and the sealing sheet is partially bonded to the accommodation body at sheet like portions (2*b*) in a manner that the whole parts of sealing sheet (5) is easily peeled off from the accommodation body.

22 Claims, 7 Drawing Sheets

PRESS-THROUGH PACK, SEALING SHEET FOR PRESS-THROUGH PACK, AND PREPARATION METHOD OF TABLET

CROSS REFERENCE TO RELATED APPLICATIONS

This is a continuation of copending International Application PCT/JP98/04452 filed Oct. 1, 1998.

TECHNICAL FIELD

The present invention relates to a press-through pack, a sealing sheet for a press-through pack and a taking-out method of tablet. Specifically, it relates to a press-through pack wherein a solid material such as a tablet or the like contained therein can be taken out easily one by one and also plural solid materials or all solid materials are taken out at one time if desired, a sealing sheet appropriate for producing such a press-through pack, and a taking-out method of tablets wherein all dividable tablets contained in the press-through pack can be divided at one time and all of the divided tablets in each storage recess of an accommodation body can be obtained at one time.

BACKGROUND ART

A press-through pack (generally called as PTP package) can contain a solid material one by one in each storage recess (or pocket) tightly and hygienically sealed and a solid material contained in the storage recess can be easily obtained one by one. Therefore, such a press-through pack has been widely used for individually packing medicines such as a tablet and a capsule, and confections such as a candy.

FIG. 7 shows a sectional view of one embodiment of such a press-through pack. The press-through pack 101 is provided with an accommodation body 102 and a sealing sheet 105 and is constructed such that an adhesive layer 104 of the sealing sheet 105 is bonded to sheet like portions 102*b*, . . . 102*b* of the accommodation body 102.

The accommodation body 102 is made of synthetic resin such as polyvinyl chloride, polypropylene and cyclic polyolefin and plural storage recess 102*a*, . . . 102*a* generally formed according to the shape of solid materials T, . . . T to be contained are connected to the sheet like portions 102*b*, . . . 102*b*.

The sealing sheet 105 has a substrate 103 made of aluminum foil or the like and an adhesive layer 104 provided on one surface of the substrate 103.

According to the press-through pack 101, the adhesive layer 104 of the sealing sheet 105 and the sheet like portions 102*b*, . . . 102*b* of the accommodation body 102 are bonded while containing the solid materials T, . . . T in the plural storage recesses 102*a*, . . . 102*a* of the accommodation body 102 respectively, and the accommodation body 102 is tightly sealed by the sealing sheet 105.

According to such a press-through pack 101, when each projecting portion 102*c*, . . . 102*c* as outer surface of each storage recess 102*a*, . . . 102*a* is pressed, areas R1, . . . R1 of the sealing sheet 105 tightly sealing each storage recess 102*a*, . . . 102*a* are ruptured by solid materials T, . . . T contained in each of the storage recesses 102*a*, . . . 102*a*, thereby the solid materials T, . . . T can be obtained out of the press-through pack 101 one by one.

On the other hand, the dosage amount of medicine is required to be varied depending on the weight, age and soon of the patient to be dosed. Therefore, many tablets are provided with a dividing line along which the tablets are easily divided by fingers or tools.

However, the prior press-through pack 101 is designed such that the solid materials T, . . . T each contained in the recesses 102*a*, . . . 102*a* are obtained one by one. Therefore, when medicine containing plural different components is dividedly packed for one dosage to a patient at a hospital, a clinic or a pharmacy, a pharmacist takes the solid materials T, . . . T out of the press-through pack 101 one by one and the removed solid materials T, . . . T are dividedly packed for one dosage by means of a dividedly packing machine. It takes trouble and time for taking the solid materials T, . . . T out of the press-through pack 101 one by one. It is requested by a pharmacist and an administrator at a medical site to provide a press-through pack by which the solid materials T, . . . T can be obtained one by one and also easily all the solid materials T, . . . T can be obtained at one time.

Aluminum foil is widely used as the substrate 103 of the sealing seat 105 because it is highly dampproof, the solid materials T can be easily obtained, and it is posh. However, the aluminum substrate 103 and the accommodation body 102 aren't separately disposed after all the solid materials T, . . . T are taken out of the press-through pack 101 so that the treatment of disposed materials is difficult and they aren't recycled.

DISCLOSURE OF THE INVENTION

The present invention is proposed to meet the above-mentioned request.

Accordingly, an object of the invention is to provide a press-through pack by which the solid materials stored therein can easily be obtained one by one, plural solid materials or all of the solid materials can be obtained at one time and which can be disposed after separating a sealing sheet and an accommodation body. And it is also an object of the invention to provide a sealing sheet which can easily make such a press-through pack.

Many dividable tablets are obtained from a press-through pack 101 one by one and each one is manually divided. Such a work takes a lot of troubles and long time although they have dividing lines so as to be easily divided by a punch as mentioned above. It is expected by pharmacists for a long time to propose a taking-out method of tablets wherein a large amount of tablets are divided at one time and the divided tablets are easily gathered at one time in order to improve efficiency of dispensation work.

A further object of the present invention for satisfying the pharmacist's request is to provide a taking-out method wherein dividable tablets contained in a press-through pack are taken out one by one, also a lot of the dividable tablets are divided at one time, and the divided tablets are gathered at one time.

According to the claim 1 of the present invention, a press-through pack comprised of an accommodation body having plural storage recesses provided with sheet like portions therebetween, and a sealing sheet having a substrate on which one surface side an adhesive layer is formed, said accomodation body being sealed tightly by said sealing sheet in a manner that said adhesive layer and said sheet like portions are bonded to each other with a solid material contained in each of said plural storage recesses wherein, said sealing sheet is made of such material that the part of said sealing sheet responding to said recess, a part in which a solid material is contained, is partly ruptured without causing floating and peeling of adhesion portion between said adhesive layer of said sealing sheet and said sheet like portion of said accommodation body when pushing the projecting portion of the outer side of said recess with fingers, whereby said solid material contained in said recess is taken out and said sealing sheet is further bonded to said sheet like portions of said accommodation body in a manner that said sealing sheet is easily peeled off from said accommodation body.

Here "the sealing sheet is further bonded to the sheet like portions of the accommodation body in a manner that the sealing sheet is easily peeled off from the accommodation body" means the sealing sheet is bonded to the sheet like portion of the accommodation body so that the sealing sheet is exfoliated from the sheet like portion of the accommodation body easily and without being ruptured when a part of the sealing sheet of the press-through pack is peeled off.

The material of the accommodation body or the substrate of the sealing sheet isn't limited if it can be used for a press-through pack for packing pharmaceuticals, drugs for animals and plants, confections, health foods, fishing baits, toys and so on.

The press-through pack of the claim 2 of the present invention is characterized in that the solid material is a dividable tablet.

More than one dividable tablet may be contained in any of the storage recesses of the accommodation body of the press-through pack. The dividable tablet may be contained in the storage recess in such a manner the surface having a dividing line faces the accommodation body or the surface opposite to the one having a dividing line faces the accommodation body. Further, those tablets may be mixed at random.

"A dividable tablet" preferably has a dividing line at the center of the surface thereof and can be divided along the dividing line when pressure is applied on the surface or the back of the tablet so that the force is concentrated on the dividing line. More specifically, it is preferable to use a dividable tablet which has a dividing line at its center of the surface and at least one of the surface having a dividing line or its opposite surface may be formed concave or convex.

Such a dividable tablet may be a naked tablet (uncoated tablet) or a coated tablet which is appropriately coated with coating material on the naked tablet.

The diameter of a dividable tablet is preferably from 3 mm to 30 mm and more preferably from 5 mm to 12 mm.

The tabletting pressure for manufacturing a dividable tablet is preferably not more than 50N of pressure in the thickness direction when the tablet is divided and more preferably from 15N to 40N.

According to the press-through pack of the claim 3 of the present invention, the bonding strength of the sealing sheet and the sheet like portion of the accommodation body in the press-through pack of the claim 1 or 2 is not less than 0.9N/15 mm width and not more than 3.1N/15 mm width in T peeling test executed at a peeling speed of 200 mm/min.

The unit "N/15 mm width" used in the specification means peeling strength when T peeling test is executed wherein the accommodation body and the sealing sheet are bonded, thereafter the bonded portion thereof is cut into 15 mm width and the cut piece is used as a test sample.

The term "T peeling test" means a test according to JIS (Japanese Industrial Standards) K6845.

In the above-mentioned range, peeling or floating between the accommodation body and the sealing sheet isn't caused at the bonded portion of the sheet like portion of the accommodation body and the adhesive layer of the sealing sheet other than the storage recesses (so called a pocket) from where solid materials are taken by breaking the sealing sheet tightly sealing the storage recesses by pushing the projecting portions as outer surface of the storage recesses containing the solid materials into the sheet direction with fingers, and the sealing sheet is bonded to the sheet like portion of the accommodation body so as to be easily peeled from the accommodation body without the sealing sheet ruptured.

Contrary under the above-mentioned range, the sealing sheet can be peeled off from the accommodation body without being broken. However, peeling or floating is caused at the bonded portion of the sheet like portion of the accommodation body and the adhesive layer of the sealing sheet other than the storage recesses from where solid materials are taken by breaking the sealing sheet tightly sealing the storage recesses by pushing the projecting portions as outer surface of the storage recesses containing the solid materials into the sheet direction with fingers.

Above the above-mentioned range, peeling or floating isn't caused at the bonded portion of the sheet like portion of the accommodation body and the adhesive layer of the sealing sheet other than the storage recesses from where solid materials are taken by breaking the sealing sheet tightly sealing the storage recesses by pushing with fingers. However, it is difficult to peel off or exfoliate the sealing sheet from the accommodation body. When the sealing sheet is forcedly peeled off, a part of the sealing sheet is ruptured.

The bonding strength of the bonded part between the sealing sheet and the sheet like portion of the accommodation body is preferably from 1.3N/15 mm width to 2.7N/15 mm width when T peeling test is carried out at a peeling speed of 200 mm/min.

According to the press-through pack of the claim 4 of the present invention, the bonding strength of the sealing sheet and the sheet like portion of the accommodation body in the press-through pack of the claim 1 or 2 is not less than 4.2N/15 mm width and not more than 7.0N/15 mm width in T peeling test executed at a peeling speed of 100 mm/min.

In the above-mentioned range, peeling or floating isn't caused at the bonded portion of the sheet like portion of the accommodation body and the adhesive layer of the sealing sheet other than the storage recesses (so called a pocket) from where solid materials are taken by breaking the sealing sheet tightly sealing the storage recesses by pushing projecting portions as outer surface of the storage recesses containing solid materials into the sheet direction with fingers, and the sealing sheet is bonded to the sheet like portion of the accommodation body, so as to be easily exfoliated from the accommodation body without the sealing sheet ruptured.

Contrary under the above-mentioned range, the sealing sheet can be peeled off from the accommodation body without being broken. However, peeling or floating is caused at the bonded portion of the sheet like portion of the accommodation body and the adhesive layer of the sealing sheet other than the storage recesses from where solid materials are taken by breaking the sealing sheet tightly sealing the storage recesses by pushing the projecting portions as outer surface of the storage recesses containing the solid materials into the sheet direction with fingers.

Above the above-mentioned range, peeling or floating isn't caused at the bonded portion of the sheet like portion of the accommodation body and the adhesive layer of the sealing sheet other than the storage recesses from where solid materials are taken by breaking the sealing sheet tightly sealing the storage recesses by pushing with fingers. However, it is difficult to peel off or exfoliate the sealing sheet form the accommodation body. When the sealing sheet is forcedly peeled off, a part of the sealing sheet is ruptured.

The bonding strength of the bonded part between the sealing sheet and the sheet like portion of the accommodation body is preferably from 4.8N/15 mm width to 6.5N/15 mm width in T peeling test executed at a peeling speed of 100 mm/min.

According to the press-through pack of the present invention, an adhesion lowering component may be mixed for an adhesive component of the adhesive forming the adhesive layer of the sealing sheet.

The "adhesive component" means an adhesive ordinarily used for heat sealing or cold sealing.

The "adhesion lowering component" means a component for weakening the bonding strength of an adhesive component such as an adhesive with lower bonding strength or a component ordinarily used for a molding lubricant or a filler. A resin used for a molding lubricant is for example a silicone resin or fluorocarbon polymer. When the accommodation body is made of polyvinyl chloride, acrylic resin can be used as an adhesion lowering component.

As a filler, pulverized powder such as silicon oxide, magnesium silicate, titanium oxide, zinc white, calcium carbonate, almina, and talk can be used.

According to the press-through pack of the present invention, the bonding strength is adjusted by mixing an appropriate amount of bonding strength lowering component in an adhesive component so that peeling or floating isn't caused at the bonded portion of the sheet like portion of the accommodation body and the adhesive layer of the sealing sheet other than the storage recesses (so called a pocket) from where the solid materials are taken by breaking a part of the sealing sheet tightly sealing the storage recesses by pushing the projecting portions as outer surface of the storage recesses containing the solid materials into the sheet direction with fingers, and the sealing sheet is bonded to the sheet like portion of the accommodation body so as to be easily exfoliated from the accommodation body without the sealing sheet ruptured.

According to the press-through pack of the present invention, the adhesive layer of the sealing sheet may be coated on one surface of the sealing sheet of the press-through pack by a partial coating method.

As the "partial coating method", various methods may be conceived, and an adhesive may be coated on the surface facing the accommodation body of the sealing sheet like cross lines or lines or both cross lines and lines only if the solid materials contained in the storage recesses can be completely sealed.

According to such a press-through pack of the present invention, the bonding strength is adjusted by applying the adhesive partially so that peeling or floating isn't caused between the accommodation body and the sealing sheet other than the so-called pocket from where solid materials are taken by breaking a part of the sealing sheet tightly sealing the storage recesses by pushing the projecting portions as outer surface of the storage recesses containing the solid materials into the sheet direction with fingers, and the sealing sheet is bonded to the sheet like portion of the accommodation body so as to be easily peeled from the accommodation body without the sealing sheet ruptured.

According to the sealing sheet for a press-through pack of the present invention, solid materials contained in a press-through pack can be taken out one by one and also plural solid materials are all the solid materials are taken out at one time if desired.

The sealing sheet for a press-through pack of the present invention is provided with a substrate and an adhesive layer on one surface of the substrate, said adhesive layer being bonded to a sheet like portion of an accommodation body having plural storage recesses with sheet like portions therebetween, and said sealing sheet tightly sealing the accommodation body wherein, said sealing sheet is made of such material that the part of said sealing sheet responding to said recess, a part in which a solid material is contained, is partly ruptured without causing floating and peeling of adhesion portion between said adhesive layer of the sealing sheet and said sheet like portion of the accommodation body when pushing the projecting portion of the outer side of said recess with fingers, whereby said solid material contained in said recess is taken out and said sealing sheet is further bonded to said sheet like portions of said accommodation body in a manner that said sealing sheet is easily peeled off from said accommodation body by fingers.

According to the sealing sheet for the press-through pack according to the present invention, the bonding strength of the sealing sheet for the press-through pack and the sheet like portion of the accommodation body is not less than 0.9N/15 mm width and not more than 3.1N/15 width in T peeling test executed at a peeling speed of 200 mm/min.

More preferably, the bonding strength of the sealing sheet and the sheet like portion of the accommodation body is not less than 1.3N/15 mm width and not more than 2.7N/15 mm width in T peeling test executed at a peeling speed of 200 mm/min.

According to the sealing sheet for the press-through pack of the present invention, the bonding strength of the sealing sheet for the press-through pack and the sheet like portion of the accommodation body is not less than 4.2N/15 mm width and not more than 7.0N/15 mm width in T peeling text executed at a peeling speed of 100 mm/min.

More preferably, the bonding strength of the sealing sheet and the sheet like portion of the accommodation body is not less than 4.8N/15 mm width and not more than 6.5N/15 mm width when T peeling test is executed at a peeling speed of 100 mm/min.

The taking-out method of tablets of the present invention is characterized in that all dividable tablets contained in the press-through pack are divided at one time and the divided tablets are easily obtained at one time. According to such a method, the press-through pack is placed on a flat plate and all dividable tablets contained in each storage recess of the accommodation body of the press-through pack are divided by applying an equal force from upward of the press-through pack placed on the flat plate by means of a flat plate, and the sealing sheet is peeled off the accommodation body and all the divided tablets contained in each storage recess of the accommodation body are obtained at once.

BRIEF DESCRIPTION OF DRAWINGS

FIG. 3(*a*) is its plane view, FIG. 3(*b*) is its back view, and FIG. 3(*c*) is its side view.

FIG. 4(*a*) is its plane view, FIG. 4(*b*) is its back view, and FIG. 4(*c*) is its side view.

FIG. 5(*a*) is its plane view, FIG. 5(*b*) is its back view, and FIG. 5(*c*) is its side view.

FIG. 6(*a*) is its plane view, FIG. 6(*b*) is its back view, and FIG. 6(*c*) is its side view.

BEST MODE FOR CARRYING OUT OF THE INVENTION

The present invention will be more detailed referring to the attached drawings.

Figure 1:
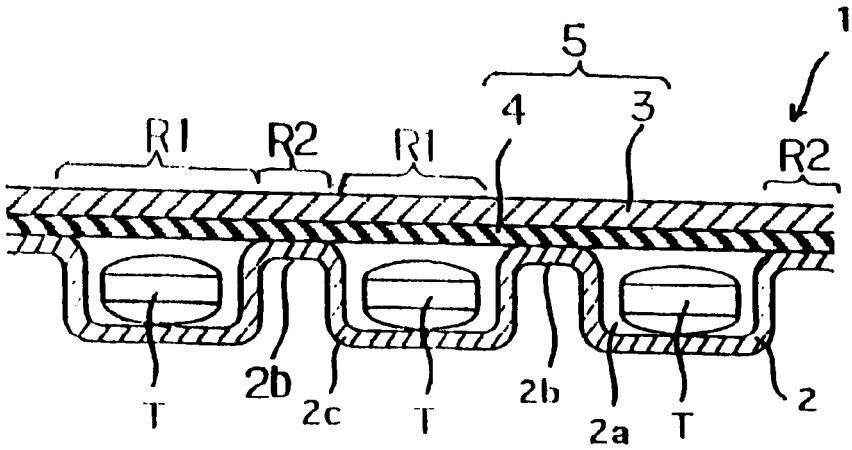
FIG. 1 is a sectional view of one embodiment of the press-through pack of the present invention.

FIG. 1 shows a sectional view of one embodiment of the press-through pack of the present invention. The press-through through pack 1 is provided with an accommodation body 2 and a sealing sheet 5 and an adhesive layer 4 of the sealing sheet 5 is bonded to sheet like portions 2*b*, . . . 2*b* of the accommodation body 2.

The accommodation body 2 is thermoformed according to the shape of solid materials T, . . . T to be contained and plural storage recesses 2*a*, . . . 2*a* are connected with the sheet like portions 2*b*, . . . 2*b*.

The material for the accommodation body 2 may be thermoplastic synthetic resin such as polyvinyl chloride, polypropylene, polystyrene, cyclic polyolefin and so on. When such a material is used for the accommodation body 2, the plural storage recess 2*a*, . . . 2*a* can be easily thermoformed according to the shape of the solid materials T, . . . T to be contained.

The sealing sheet 5 has a substrate 3 and the adhesive layer 4 provided at one surface of the substrate 3.

Many kinds of packaging material can be used for the substrate 3 of the sealing sheet 5 wherein the material can seal the solid materials T, . . . T to be contained in each storage recess 2*a*, . . . 2*a* of the accommodation body 2 and can be easily ruptured by the contained solid materials T, . . . T when projecting portions 2*c*, . . . 2*c* as outer surface of the storage recesses 2*a*, . . . 2*a* are pushed into the direction of the sealing sheet 5. For example, aluminum foil, glassine paper, synthetic resin sheet containing a filler for easy breakage, a paper, and the like are exemplified.

When aluminum foil is used for the substrate 3 of the sealing sheet 5, its thickness is preferably not less than 5 $\mu$m and not more than 30 $\mu$m, and more preferably it is a hard foil from 15 $\mu$m to 25 $\mu$m.

When glassine paper is used for the substrate 3 of the sealing sheet 5, 30.5 g/m$^2$ of basis weight (weight per m$^2$) is preferable.

When synthetic resin sheet containing a filler for easy breakage is used for the substrate 3 of the sealing sheet 5, its thickness is preferably from 9 $\mu$m to 100 $\mu$m, and more preferably from 12 $\mu$m to 80 $\mu$m.

Thermoplastic synthetic resin such as polyvinyl chloride, polypropylene, polystyrene, or striated polyolefin is preferably used as synthetic resin.

There are silicon oxide, magnesium silicate, titanium oxide, zinc white, carcium carbonate, alumina, talc and the like as a filler contained in the synthetic resin. The average particle diameter is from 1 $\mu$m to 10 $\mu$m and the filler may be contained in the synthetic resin from 5 weight % to 15 weight %, more preferably from 5 weight % to 70 weight %.

When paper is used for the substrate 3 of the sealing sheet 5, the basis weight is preferably from 13 g/m$^2$ to 100 g/m$^2$.

The physical property and composition of the substrate 3 of the sealing material 5 are such that solid materials T can be taken out by breaking areas R1, . . . R1 sealing the storage recesses 2*a*, . . . 2*a* of the sealing sheet 5 which seal the storage recess, when the projecting portions 2*c* as outer surface of the storage recesses 2*a* containing the solid materials T are pushed by fingers.

Although the above-mentioned construction is the same as the prior press-through pack 101, according to the press-through through pack 1 of the present invention, the bonding strength of the adhesive layer 4 of the sealing sheet 5 and the sheet like portions 2*b*, . . . 2*b* of the accommodation body 2 is adjusted such that breakage of the sealing sheet 5 doesn't spread to adhesive parts R2, . . . R2 of the sheet like portion 2*b* and the adhesive layer 4, and only the areas R1, . . . R1 of the sealing sheet 5 (so called a pocket) sealing the storage recesses 2*a*, . . . 2*a* are ruptured so that the solid materials T, . . . T can be taken out one by one when each projecting portion 2*c*, . . . 2*c* as outer surface of the storage recesses 2*a*, . . . 2*a* containing the solid materials T, . . . T is pushed in the direction of the sealing sheet 5 by fingers. It is also adjusted such that the sealing seat 5 can be easily separated from the accommodation body 2 without being ruptured halfway.

Then adjustment method of bonding strength of the sealing sheet 5 will be explained for the cases when the bonding strength of the adhesive layer 4 is adjusted by the component of the adhesive and when the bonding strength of the adhesive is adjusted by a coating method for the substrate 3 of the sealing sheet 5.

A. Case that Bonding Strength is Adjusted by the Component of Adhesive

In this case appropriate amount of adhesion lowering component is included in the adhesive component.

Any material can be used for the adhesive component if it can bond the accommodation body 2 and the substrate 3 of the sealing sheet 5, and for example, thermoplastic resin capable of heat sealing or cold sealing adhesive capable of cold sealing may be used.

Vinyl chloride vinyl acetate copolymer can be preferably used as thermoplastic resin capable of heat sealing when the accommodation body 2 is made of polyvinyl chloride, chlorinated polypropylene or carboxyl polypropylene is preferably used for the accommodation body 2 made of polypropylene, and the mixture of vinyl chloride/vinyl acetate copolymer and acrylic acid resin is preferably used for the accommodation body 2 made of polystyrene, however, the present invention isn't limited to such a material.

Acrylic acid resin, silicon resin, rubber or the like may be used as a cold sealing adhesive.

The "cold sealing adhesive" indicates an adhesive which can bond members only by pressurizing.

As the adhesion lowering component included in the adhesive, any material which can lower the bonding strength of the adhesive layer 4 of the sealing sheet 5 and the accommodation body 2 or the bonding strength of the adhesive layer 4 of the sealing sheet and the substrate 3 of the sealing sheet 5 may be used.

For example, resin used as molding lubricant such as silicon resin or fluorine-contained resin, acrylic acid resin, or striated polyester resin is preferable.

Pulverized powder used as a filler such as silicon oxide, magnesium silicate, titanium oxide, zinc white, calcium carbonate, alumina, or talc is also preferable.

The composition ratio of the adhesive component of the adhesive and the adhesion lowering component is determined according to the result of an bonding strength test, an extrusion test and a peeling test which will be explained later.

B. Case that Bonding Strength is Adjusted by a Coating Method of Adhesive on the Substrate of the Sealing Sheet In this case, a desirable bonding strength can be obtained by coating an adhesive on the substrate 3 of the sealing sheet 5 entirely or partially or by adjusting the coating amount of an adhesive per unit area on the substrate 3 of the sealing sheet 5.

When the adhesive is partially coated, it may be coated like a mesh or lines on the surface facing to the accommodation body 2 of the sealing sheet 5 only if the solid materials T, . . . T can be completely sealed in each storage recess 2*a* of the accommodation body 2 respectively, or such a coating method may be combined.

When the coating amount per unit area on the substrate 3 of the sealing sheet 5 is adjusted, a thinner may be mixed in the adhesive or the layer thickness per unit area of the adhesive coated on the substrate 3 of the sealing sheet 5 may be adjusted.

When the bonding strength is adjusted by a coating method of the adhesive on the substrate 3 of the sealing sheet 5, adhesive lowering component may be contained or not contained in the adhesive.

Next, the present invention will be explained exemplifying concrete experimental results.

(Experiment 1)

(Manufacturing of a Sealing Sample for a Bonding Strength Test of a Sealing Sheet and a Sheet Like Portion of an Accommodation Body)

Heat sealing agent for polyvinyl chloride (Leader Co., Ltd., brand name: LD830G) of which main ingredient was copolymer of vinyl chloride and vinyl acetate was used as an adhesive component. Acrylic resin (Konishi Co., Ltd., brand name: KV610) which was an adhesive lowering component was mixed and plural samples of an adhesive agent solution of which heat sealing strength (bonding strength) was adjusted by varying its component ratio were prepared. The samples were coated on the surface of an aluminum foil (hard foil) (the substrate 3 of the sealing sheet 5) with 20 $\mu$m thickness by means of a bar coater #12.

Then the aluminium foils (the substrate 3 of the sealing sheet 5) were dried by a heat dryer at 200° C. for 20 seconds and plural sealing sheets 5 having adhesive layers 4 with several bonding strengths were manufactured.

Such manufactured sealing sheets 5 were thermally sealed with polyvinyl chloride sheet (Sumitomo Bakelite Co., Ltd., brand name: VSS1202) as the accommodation body 2 by means of a heat sealer (Yasuda Seiki Co., Ltd., lever type heat sealer) having a flat plate as a heat seal bar at 150° C.×3 Kg pressure/c $m^2$×1 second.

(Bonding Strength Test of a Sealing Sheet and a Sheet Like Portion of an Accommodation Body)

The above-mentioned thermoformed sheets were cut into 15 mm width and the cut pieces were used as samples for measuring bonding strength.

Bonding strength test was executed by measuring peeling strength by means of Instoron type tensile strength measuring device (Shimadzu Corporation, type: AGS-100-D).

T peeling test was executed at 200 mm/min. peeling speed according to JIS K6845.

(Manufacturing of an Evaluation Sample for an Extrusion Test and a Peeling Test)

Plural press-through packs 1 were manufactured by heat sealing each sealing sheet 5 having the above-mentioned adhesive layer 4 on the aluminum foil (the substrate 3 of the sealing sheet 5) and the accommodation body 2 by means of a PTP filling machine (CKD Corporation, type: M-1).

Polyvinyl chloride sheet (Sumitomo Bakelite Co., Ltd., brand name: VSS1202) was used for the accommodation body 2, No.4 capsule as a solid substrate T was contained in each storage recess 2*a* made by thermoforming, and the accommodation body 2 was heat sealed at 190° C., thereby evaluation samples were manufactured for an extrusion test and a peeling test. The sheet without storage recesses 2*a* was cut into 15 mm width for which a bonding strength test of the sealing sheet and the sheet like portion of the accommodation body was executed.

(Extrusion Test)

For each press-through pack 1 manufactured as mentioned above, the No.4 capsule contained in each storage recess 2*a* was obtained by breaking the sealing sheet 5 by pushing (by fingers) the contained capsule from the projecting portion 2*c* (polyvinyl chloride sheet side) as outer surface of the storage recess of the accommodation body 2 into the direction of the sealing sheet 5. Peeling and floating were observed for the adhesion areas R2 of the adhesive layer 4 of the sealing sheet 5 and the sheet like portions 2*b*, . . . 2*b* of the accommodation body 2 except for the areas R1 sealing the storage recess 2*a* from which the No.4 capsules were obtained.

When peeling and floating of the sealing sheet 5 weren't observed at the areas R2, it was evaluated as good (○). When peeling and floating were partially observed at the areas R2 other than the areas R1 corresponding to storage recesses 2*a* from which the No.4 capsules were obtained, it was evaluated as not so good (Δ). When peeling and floating were widely observed at the areas R2 other than the areas R1 corresponding to storage recesses 2*a* from which the No.4 capsules were obtained, it was evaluated as not good (X).

(Peeling Test)

The same samples of the press-through pack 1 as the samples used for the extrusion test were used and rupture of the sealing sheet 5 was observed when the sealing sheet 5 was peeled off the accommodation body 2 (polyvinyl chloride sheet).

When the sealing sheet 5 was easily peeled off the accommodation body 2 (polyvinyl chloride sheet) without being ruptured or cut, it was evaluated as good (○). When the sealing sheet 5 was easily peeled off the accommodation body 2 (polyvinyl chloride sheet) however the sealing sheet 5 was cut or ruptured, it was evaluated as not so good (Δ). When the sealing sheet 5 was difficult to be peeled off the accommodation body 2 (polyvinyl chloride sheet) and was cut or ruptured when it was forcibly peeled off the accommodation body 2 (polyvinyl chloride sheet), it was evaluated as not good (X).

The result is shown in the following table 1.

TABLE 1

| bonding strength (n/15 mm width) (peel-speed: 200 mm/min.) | extrusion (No. 4 |
|---|---|

| Component ratio of adhesive | actual measurement | compensated value | cap-sule) | peel-ing |
|---|---|---|---|---|
| LD830G/KV610 = 50/50 | 4.9 | 4.8 | ○ | x |
| LD830G/KV610 = 40/60 | 3.9 | 3.9 | ○ | x |
| LD830G/KV610 = 35/65 | 3.4 | 3.5 | ○ | x |
| LD830G/KV610 = 30/70 | 3.0 | 3.1 | ○ | Δ |
| LD830G/KV610 = 25/75 | 2.7 | 2.6 | ○ | ○ |
| LD830G/KV610 = 20/80 | 2.1 | 2.2 | ○ | ○ |
| LD830G/KV610 = 10/90 | 1.3 | 1.3 | ○ | ○ |
| LD830G/KV610 = 5/95 | 1.0 | 0.9 | Δ | ○ |
| LD830G/KV610 = 3/97 | 0.8 | 0.7 | x | ○ |

According to the table 1, it was understood that the preferable bonding strength of the accommodation body 2 and the sealing sheet 5 was from 0.9N/15 mm width to 3.1N/15 mm width.

Further, it became apparent that the bonding strength of the sealing sheet 5 and the sheet like portion 2*b* of the accommodation body 2 was preferably adjusted from 1.3N/15 mm width to 2.7N/15 mm width by repeating similar tests.

The compensated value in the table 1 indicates a value on the regression line obtained by analyzing the actual measurement and is a value compensated by the following equation.

$$N=-0.0871\,X+9.1695 \quad (N\text{: compensated value})$$

$$R^2=0.9965 \quad (R\text{: confidence limit})\ X=\text{weight \% of KV610}$$

(Experiment 2)

(Manufacturing of a Sealing Sheet and a Press-through Pack)

Heat sealing agent for polyvinyl chloride (Leader Co., Ltd. Brand name: LD830G) of which main ingredient was copolymer of vinyl chloride and vinyl acetate was used as an adhesive component. Acrylic resin (Konishi Co., Ltd., brand name: KV610) which was an adhesive lowering component was mixed and plural samples of an adhesive agent solution of which heat sealing strength (bonding strength) was adjusted by varying its component ratio were prepared. The samples were coated on the surface of an aluminum foil (hard foil) with 20 μm thickness (the substrate 3 of the sealing sheet 5) by means of a bar coater #12.

Then the foils (the substrate 3 of the sealing sheet) were dried by a heat dryer at 200° C. for 20 seconds and plural sealing sheets 5 having adhesive layers 4 with several bonding strengths were manufactured.

Plural storage recesses 2*a* are thermally formed in lines for containing tablets having concave plain and 7 mm diameter (hereinafter called 7 mm diameter tablet) by a junior blister packing machine from polyvinyl chloride sheet (Sumitomo Bakelite Co., Ltd., brand name: VSS1105SF). The 7 mm diameter tablet was contained in each storage recess 2*a* formed as mentioned above. The accommodation body 2 and plural sealing sheets 5 having adhesive layers 4 of several bonding strength on the substrates 3 were thermally bonded at 130° C. by means of semi-automatic PTP packing machine (Daiwa Kasei Kogyo Co., Ltd, Type: K-200KS), thereby plural press-through packs 1 containing 7 mm diameter tablets were manufactured.

(Extrusion Test)

For each press-through pack 1 manufactured as mentioned above, the 7 mm diameter tablet contained in each storage recess 2*a* was obtained by breaking the sealing sheet 5 by pushing (by fingers) the contained tablet from the projecting portion 2*c* (polyvinyl chloride sheet side) as outer surface of the storage recess of the accommodation body 2 into the direction of the sealing sheet 5. Peeling and floating were observed for the adhesion areas R2 of the adhesive layer 4 of the sealing sheet 5 and the sheet like portions 2*b*, . . . 2*b* of the accommodation body 2 except for the areas R1 sealing the storage recesses 2*a* from which the 7 mm diameter tablets were obtained.

When peeling and floating of the sealing sheet 5 (aluminum foil) weren't observed at the areas R2, it was evaluated as good (○). When peeling and floating were partially observed at the areas R2 other than the areas R1 corresponding to storage recesses 2*a* from which the 7 mm diameter tablets were obtained, it was evaluated as not so good (Δ). When peeling and floating the sealing sheet were widely observed at the areas R2 other than the areas R1 corresponding to storage recesses 2*a* from which the 7 mm diameter tablets were obtained, it was evaluated as not good (X).

(Peeling Test)

The same samples of the press-through pack 1 as the samples used for an extrusion test were used and rupture of the sealing sheet 5 was observed when the sealing sheet 5 was peeled off the accommodation body 2 (polyvinyl chloride sheet).

When the sealing sheet 5 was easily peeled off the accommodation body 2 (polyvinyl chloride sheet) without being ruptured or cut, it was evaluated as good (○). When the sealing sheet 5 was easily peeled off the accommodation body 2 (polyvinyl chloride sheet) however it was cut or ruptured, it was evaluated as not so good (Δ). When the sealing sheet 5 was difficult to be peeled off the accommodation body 2 (polyvinyl chloride sheet) and was cut or ruptured when it was forcibly peeled off the accommodation body 2 (polyvinyl chloride sheet), it was evaluated as not good (X).

(Bonding Strength Test of a Sealing Sheet and a Sheet Like Portion of an Accommodation Body)

The bonding part R2 (where the storage recesses 2*a* of the accommodation body 2 aren't provided) of the sheet like portions 2*b* of the accommodation body 2 and the sealing sheet 5 of each press-through pack 1 manufactured as mentioned above was cut into 15 mm width and the cut pieces were used as samples for measuring bonding strength.

The bonding strength test was executed by measuring peeling strength by means of a strograph (TOYO SEIKI Co. Ltd., type: M1).

T peeling test was executed according to JIS K6845 at a peeling speed of 100 mm/min.

The result is shown in the following table 2.

TABLE 2

| Component ratio of adhesive | bonding strength (n/15 mm width) (peel-speed: 100 mm/min.) actual measurement | compensated value | extru-sion (7 mm diameter tablet) | peel-ing |
|---|---|---|---|---|
| LD830G/KV610 = 50/50 | 9.6 | 9.3 | ○ | x |
| LD830G/KV610 = 40/60 | 8.8 | 8.1 | ○ | x |
| LD830G/KV610 = 35/65 | 7.4 | 7.6 | ○ | x |
| LD830G/KV610 = 30/70 | 6.1 | 7.0 | ○ | Δ |
| LD830G/KV610 = 25/75 | 5.8 | 6.5 | ○ | ○ |
| LD830G/KV610 = 20/80 | 5.7 | 5.9 | ○ | ○ |
| LD830G/KV610 = 10/90 | 5.1 | 4.8 | ○ | ○ |

TABLE 2-continued

| Component ratio of adhesive | bonding strength (n/15 mm width) (peel-speed: 100 mm/min.) actual measurement | compensated value | extrusion (7 mm diameter tablet) | peeling |
|---|---|---|---|---|
| LD830G/KV610 = 5/95 | 4.7 | 4.2 | Δ | ○ |
| LD830G/KV610 = 3/97 | 4.1 | 4.0 | x | ○ |

From the table 2, it was understood that the preferable bonding strength of the accommodation body 2 and the sealing sheet 5 was from 4.2N/15 mm width to 7.0N/15 mm width.

Further, it became apparent that the bonding strength of the sealing sheet 5 and the sheet like portion 2*b* of the accommodation body 2 was preferably adjusted from 4.8N/15 mm width to 6.5N/15 mm width by repeating similar tests.

The compensated value in the table 2 indicates a value on the regression line obtained by analyzing the actual measurement and is a value compensated by the following equation.

$N=-0.1123\,X+14.882$ ($N$: compensated value)

$R^2=0.8968$ ($R$: confidence limit) $X$=weight % of KV610

When aluminum foil is used for the substrate 3 of the sealing sheet 5, a print layer may be provided for showing company name, brand name, brand code and so on at the surface provided with the adhesive layer 4 or its opposite surface. Further, a surface protection layer made of nitrocellulose, acrylic resin, epoxy resin, melamine resin or a mixed resin of at least two of them may be provided on the printing surface opposite to the surface with the adhesive layer 4 in order to prevent spots such as fingerprint and erosion, or to polish.

If necessary, V-shaped grooves or perforations may be provided for the sheet like portions 2*b*, . . . 2*b* of the accommodation body 2 for separating per each storage recess 2*a*, . . . 2*a*.

(Dividing Test of Dividable Tablet)

Granule including lactose—starch as additives was tabletted at various tabletting pressures and several kinds of dividable tablets having a dividable line, with 7 mm diameter and 130 mg total weight were manufactured.

TABLE 3

| Component | quantity |
|---|---|
| main ingredient | 4 mg |
| Lactose | appropriate amount |
| Starch | 40 mg |
| polyvinyl alcohol | 4 mg |
| magnesium stearate | 1 mg |
| total weight | 130 mg |

Then the press-through pack 1A as mentioned above was similarly manufactured but thus prepared several kinds of tablets were used instead of the No.4 capsule or the 7 mm diameter tablet.

Figure 2:
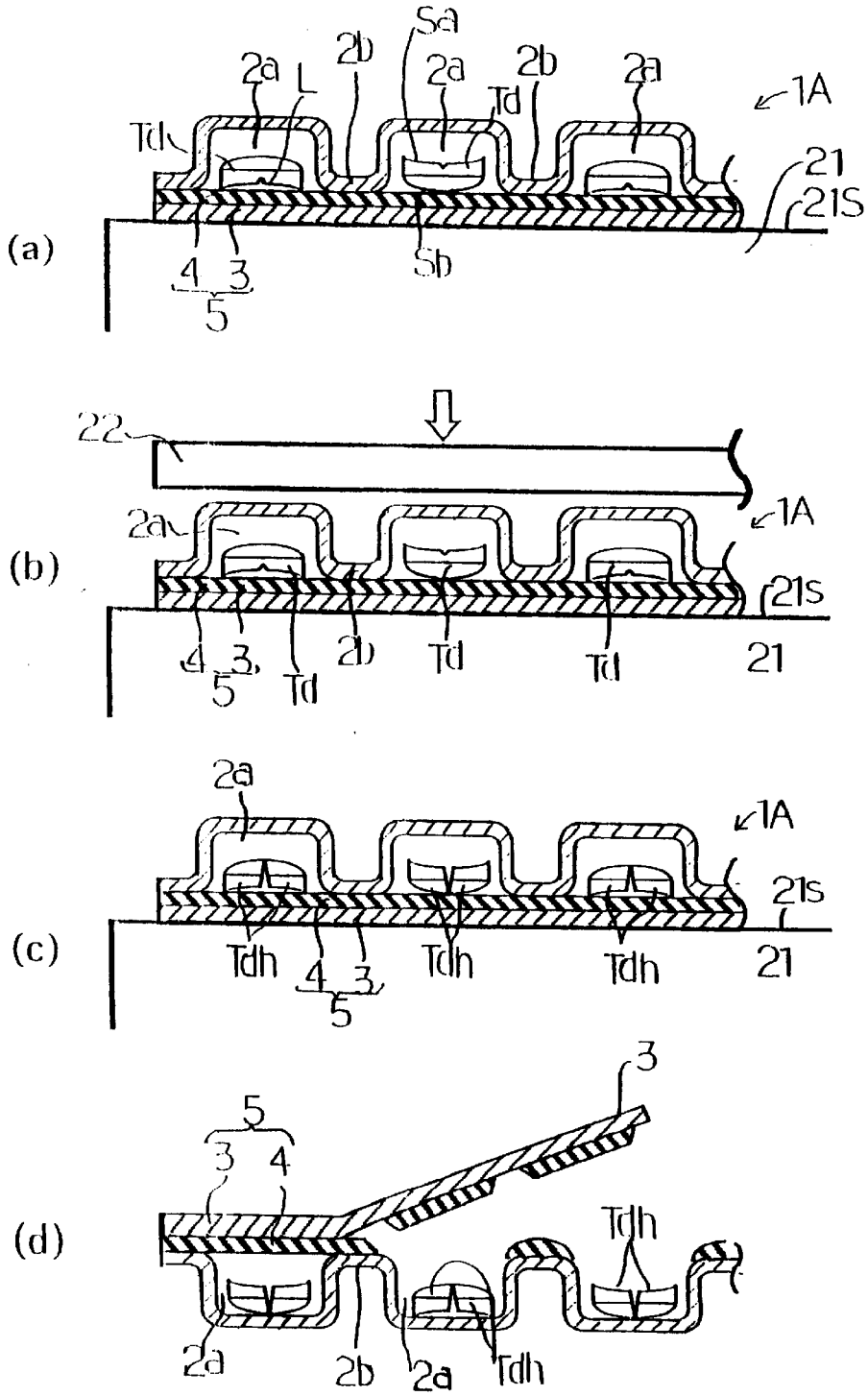
FIGS. 2*a*–2*d* are schematic diagrams showing a dividing test for dividable tablets.
Figure 3:
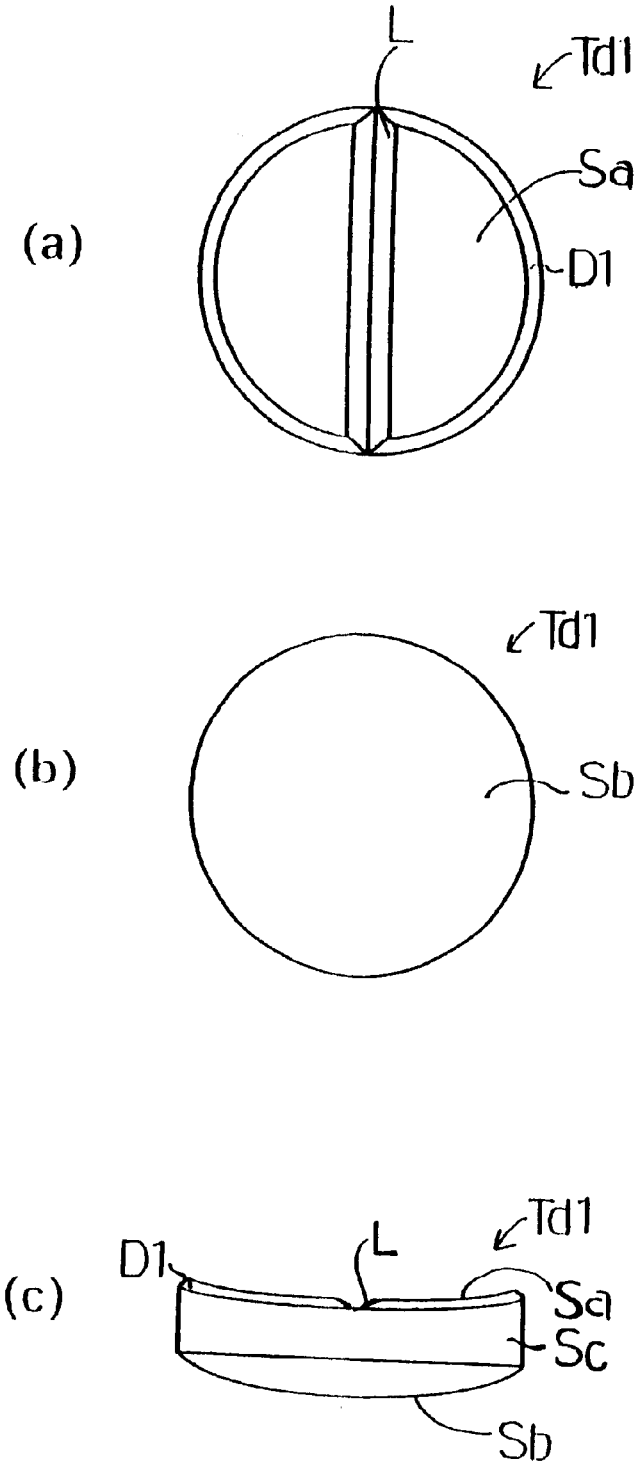
FIG. 3 shows one example of a preferable dividable tablet to be contained in the storage recess of the accommodation body of the press-through pack of the present invention.

The press-through pack 1A containing dividable tablets Td, . . . Td with a dividing line L in the storage recesses 2*a*, . . . 2*a* of the accommodation body 2 was placed on the flat plate 21S on a table 21 as shown in FIG. 2(*a*). A plastic plate 22 of about the same size as the press-through pack 1A was pressed above the press-through pack 1A so that the accommodation body 2 of the press-through pack 1A was pushed into the direction of the sealing sheet 5 (see FIG. 2(*b*)). Then the dividable tablets Td, . . . Td contained in the storage recesses 2*a*, . . . 2*a* of the accommodation body 2 were divided. The divided condition thereof were observed (see FIG. 2(*c*)).

As the result, the dividable tablets Td, . . . Td of the shapes shown in FIG. 3–FIG. 6 contained in each storage recess 2*a*, . . . 2*a*, and divided at a pressure in the direction of the thickness of tablet of not more than 50N, more specifically from 15N to 40N were all divided into two in each storage recess 2*a*, . . . 2*a*.

The shapes of the dividable tablets will be explained in more detail. The dividable tablet Td1 in FIG. 3 has a V-shaped dividing line L at a center of one surface Sa thereof. The surface Sa of the tablet Td1 provided with the dividing line L is formed concave so that the deepest portion accords with the position of the dividing line L and a corner D1 of the concave surface and a side Sc of the tablet is rounded. Further, a surface Sb opposite to the surface Sa of the tablet Td1 having the dividing line L is formed convex of which highest portion accords with the most deepest portion of the dividing line L.

When pressure is applied on the dividable tablet Td1, ripping force is concentrated on the dividing line L by cooperation of the concave surface Sa and the convex surface Sb so that the dividable tablet Td1 can be easily divided along the dividable line L.

Figure 4:
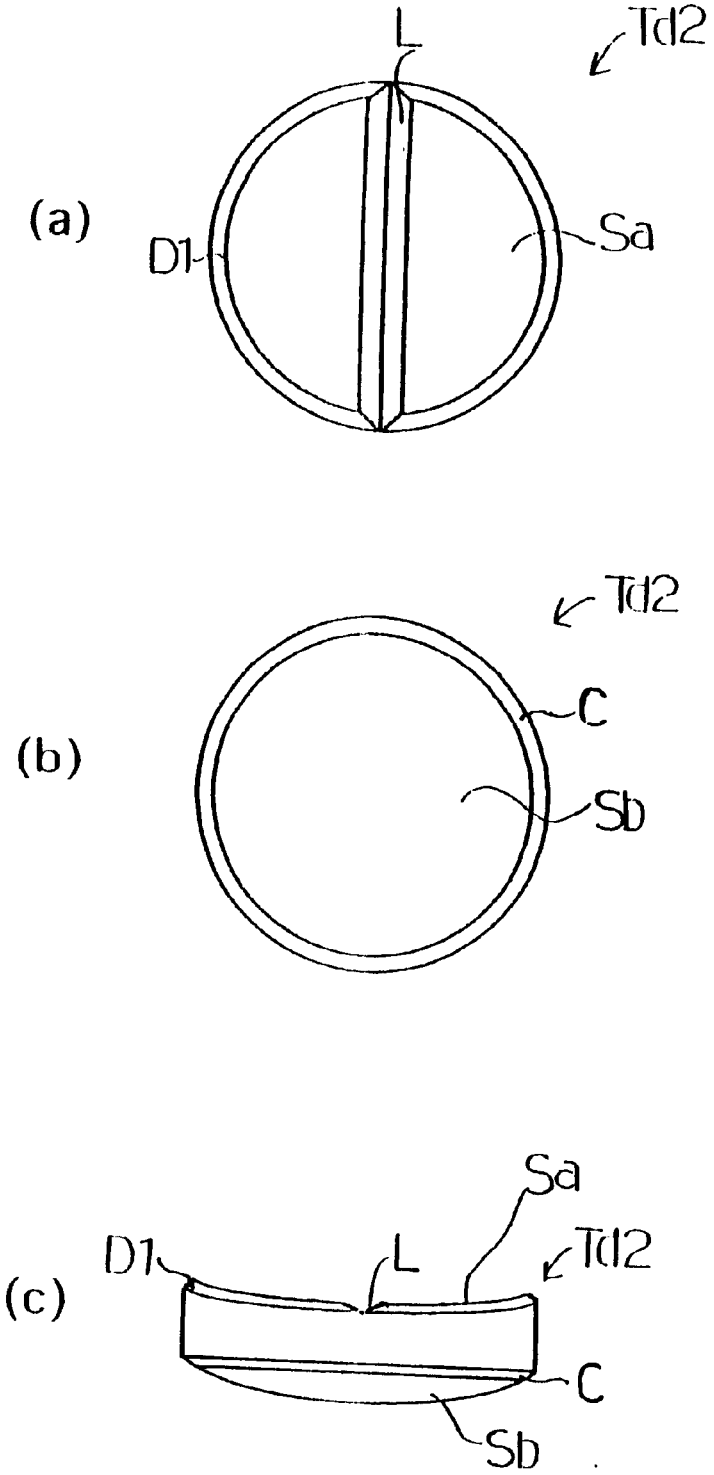
FIG. 4 is another example of a preferable dividable tablet to be contained in the storage recess of the accommodation body of the press-through pack of the present invention.

The dividable tablet Td2 in FIG. 4 is provided with an annular part C with a fixed space from its circumference for a design purpose on the surface Sb opposite to the surface Sa having a dividing line L and also provided with a convex surface inside of the annular part C. Its construction is actually similar to the construction of the dividable tablet Td1 and their effects are the same.

Figure 5:
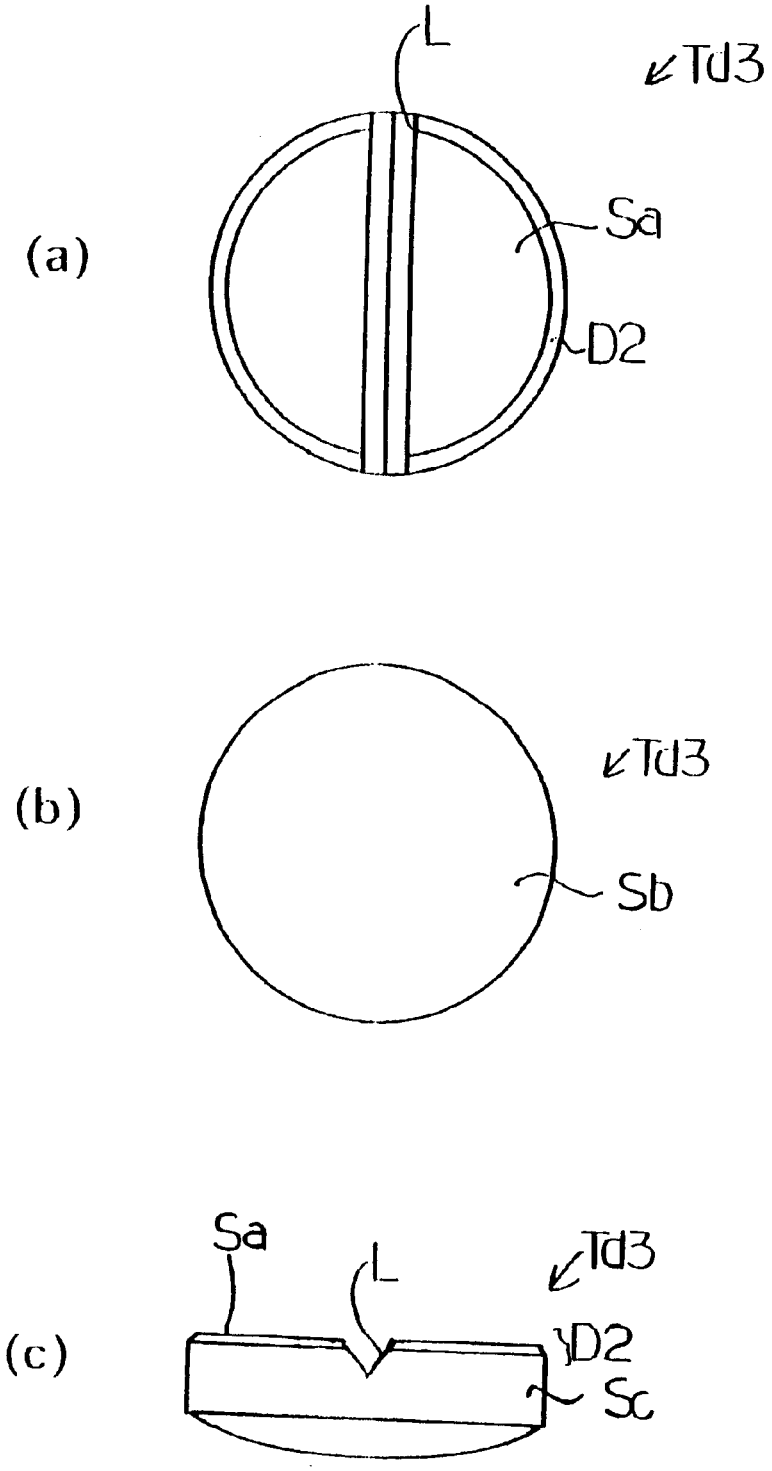
FIG. 5 is still further example of a preferable dividable tablet to be contained in the storage recess of the accommodation body of the press-through pack of the present invention.

The dividable tablet Td3 in FIG. 5 is provided with a V-shaped dividing line L of which deepest portion is deeper than a corner D2 of a surface Sa and a side Sc of the tablet Td3. The surface Sa with the dividing line L is flat, the corner D2 is rounded, and convex surface is formed at a surface Sb opposite to the surface Sa.

When pressure is applied on the dividable tablet Td3, ripping force is concentrated on the dividing line L because of the convex shape of the surface Sb and the dividing line L is formed V-shaped, thereby the tablet Td3 can be easily divided along the dividing line L.

Figure 6:
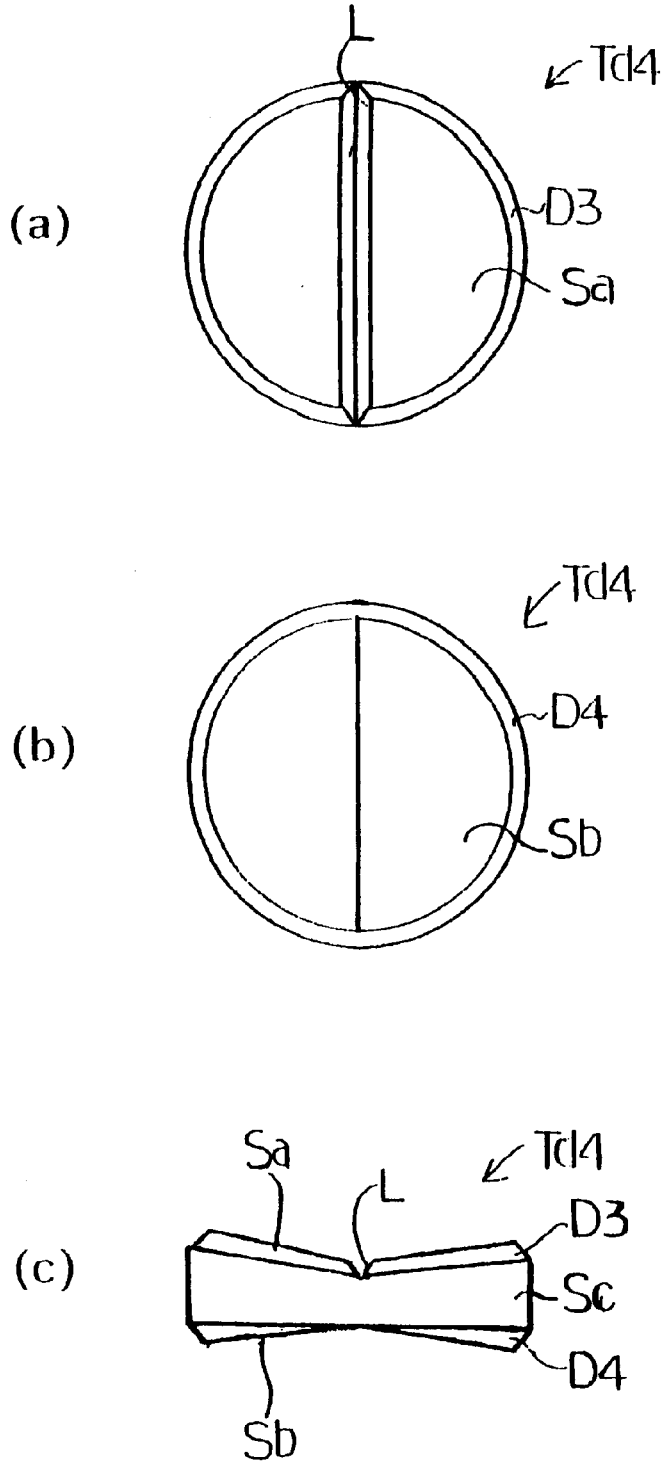
FIG. 6 is still another example of a preferable dividable tablet to be contained in the storage recess of the accommodation body of the press-through pack of the present invention.
Figure 7:
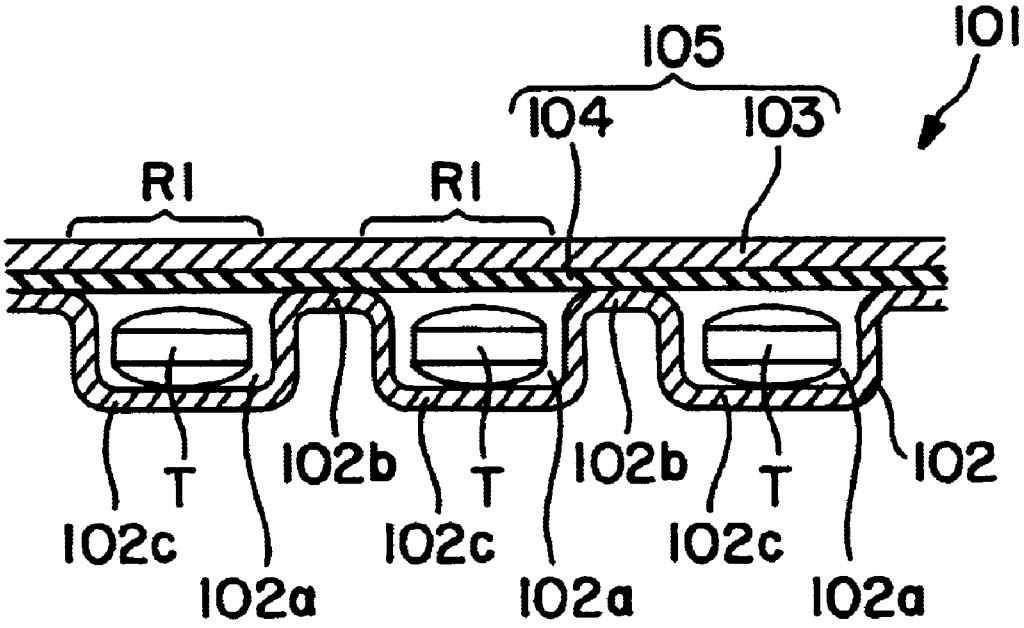
Fig. 7 PRIOR ART
FIG. 7 is a sectional view showing one example of prior press-through pack.

The dividable tablet Td4 shown in FIG. 6 has a V-shaped dividing line L at a center of one surface Sa thereof and the surface Sa is designed such that V-shaped form which is gentle comparing to the dividing line L is continued from the dividing line L to the side Sc of the tablet Td4 so that the deepest part thereof accords with the position of the dividing line L. A corner D3 of the V-shaped surface and the side Sc is rounded and a surface Sb opposite to the surface Sa is gently V-shaped having the deepest portion thereof at the center. The deepest portion of the V-shaped surface Sb is designed to be aligned with the dividing line L of the surface Sa and a corner D4 of the gently V-shaped surface Sb and the side Sc of the tablet is rounded.

When pressure is applied on the dividable tablet Td4, the tablet Td4 can be easily divided because pressure applied on the gently V-shaped surface Sa is concentrated on the dividing line L and the deepest part of the V-shaped surface Sb accords with the deepest part of the V-shaped dividing line L.

As shown in FIG. 2(*d*), the sealing sheet 5 was peeled off the accommodation body 2 of the press-through pack 1A containing divided tablets Tdh, . . . Tdh in the storage recesses 2*a*, . . . 2*a*, the sheet 5 could be peeled off without being ruptured and all the divided tablet Tdh, . . . Tdh could be obtained.

When the dividable tablets Td, . . . Td contained in the storage recesses 2*a*, . . . 2*a* were pushed into the sealing sheet 5 direction from the accommodation body 2 (polyvinyl chloride sheet) and taken out one by one by breaking the sealing sheet 5, it was observed whether peeling or floating was occurred at the areas R2 other than the areas R1 of the accommodation body 2 from where the dividable tablets Td were taken out. The press-through pack 1A containing dividable tablets Td1, Td2, Td3, Td4 in each storage recess 2*a*, . . . 2*a* didn't cause peeling or floating at the areas R2 and the dividable tablets Td1, Td2, Td3, Td4 were taken out of the press-through pack 1A without divided respectively.

Each press-through pack 1A containing the dividable tablets Td1, Td2, Td3, Td4 was packed in a box (10 tablets PTP ×100 sheets) and transported by a regular delivery method. In such a test, any of the dividable tablets Td1, Td2, Td3, Td4 contained in each storage recess 2*a*, . . . 2*a* of the press-through pack 1A weren't divided or dropped outside by breaking the sealing sheet 5.

At least one dividable tablet Td may be contained in each storage recess 2*a*, . . . 2*a* of the accommodation body 2 of the press-through pack 1A. The dividable tablet Td may be positioned in the recess 2*a* while the surface Sa with a dividing line L faces the accommodation body 2 or the surface Sb faces the accommodation body 2. Further, the surfaces Sa of some tablets Td may face the accommodation body 2 and the surfaces Sb of the others face the accommodation body 2.

The tablets Td1, Td2, Td3, Td4 are only a sample of dividable tablets contained in the storage recess 2*a*, . . . 2*a* of the accommodation body 2. Any types of dividable tablets may be used only if the tablets Td can be divided along the dividing line L when pressure is applied on the surface Sa having the dividing line L or on the surface Sb opposite to the surface Sa and the force is concentrated on the line L.

It is preferable that a concave or a convex is formed on at least one surface Sa having a dividing line L of the tablet Td or its opposite surface Sb so that the tablets can be easily divided along the dividing line L.

Such a dividable tablet may be a naked tablet (uncoated tablet) or a coated tablet wherein coating material such as sugarcoating or film coating is appropriately applied on the naked tablet.

The diameter of a dividable tablet is preferably from 3 mm to 30 mm and more preferably from 5 mm to 12 mm considering practical prescription such as patient compliance.

Industrial Applicability

According to the press-through pack of the present invention, solid materials can be obtained one by one by breaking the part of the sheet sealing the storage recess without causing floating or peeling at the adhesion area of the sheet like portion of the accommodation body and the adhesive layer of the sealing sheet when the projecting portions as outer surface of the storage recess containing solid materials are pushed in the direction of the sealing sheet by fingers. Further, when the sealing sheet was peeled off the accommodation body, plural or whole solid materials contained in the press-through pack can easily be obtained at one time because the sealing sheet is bonded to the accommodation body so as to be easily peeled off without being broken.

The accommodation body and the sealing sheet can be easily separated after all the solid materials are obtained so that disposal treatment and recycle are easily accomplished by disposing them separately.

Further according to the present invention, when dividable tablets are contained in the storage recesses, they can be obtained one by one and also a large amount of tablets can be divided at one time and the divided tablets can be easily obtained at one time.

When the press-through pack of the present invention is used, solid materials can be obtained by pushing the projecting portions as outer surface of the storage recesses containing solid materials and breaking the part of the sheet sealing the storage recesses. And also when the sealing sheet is peeled off, it can be easily separated from the accommodation body without being broken.

The press-through pack of the present invention has such an excellent effect so that it can be preferably used for individually packing materials such as solid medicine like a tablet or a capsule, confections like a candy, and solid materials like health food, fishing baits or toys.

The sealing sheet for the press-through pack of the present invention is preferably used for manufacturing individual packing form of such solid materials.

Further according to the taking-out method of the present invention, a dividable tablet can be obtained from the press-through pack one by one and also a large amount of dividable tablet can be divided in the press-through pack and obtained at one time.

What is claimed is:

1. A press-through pack, comprising:

an accommodation body having plural storage recesses containing solid materials within respective projecting portions, and a sealing sheet attached to said accommodation body, said sealing sheet comprising a substrate and an adhesive layer, said adhesive layer including an adhesion lowering component, said sealing sheet tightly sealing said storage recesses, wherein said sealing sheet adheres to said accommodation body such that a desired storage recess can be ruptured in order to allow to remove said solid material from said storage recess by pressing an outer surface of said projecting portion corresponding to said storage recess with a finger, and wherein relative strengths of said adhesive layer and said substrate permit integrally peeling and removing said substrate from said accommodation body.

2. The press-through pack as set forth in claim 1, wherein said adhesive layer is partially coated on said sealing sheet.

3. A press-through pack, comprising:

an accommodation body having plural storage recesses containing solid materials within respective projecting portions, and a sealing sheet attached to said accommodation body, said sealing sheet comprising a substrate and an adhesive layer, said adhesive layer including an adhesion lowering component, wherein said sealing sheet adheres to said accommodation body such that a desired storage recess can be ruptured in order to allow to remove said solid material from said storage recess by pressing an outer surface of said projecting portion corresponding to said storage recess with a finger, and wherein relative strengths of said adhesive layer and said substrate permit integrally peeling and removing said substrate from said accommodation body to allow simultaneously removing plural solid materials from said storage recesses.

4. The press-through pack as set forth in claim 3, wherein said adhesive layer is partially coated on said sealing sheet.

5. The press-through pack as set forth in claims 1–4, wherein the bonding strength of said sealing sheet to said accommodation body is defined in the range from 0.9N/15 mm width to 3.1N/15 mm width when T peeling test of JIS Number K6845 at a peeling speed of 200 mm/min.

6. The press-through pack as set forth in claims 1–4, wherein the bonding strength of said sealing sheet to said accommodation body is defined in the range from 4.2N/15 mm width to 7.0N/15 mm width when T peeling test of JIS Number K6845 at a peeling speed of 100 mm/min.

7. The press-through pack as set forth in claim 5, wherein said solid material is a dividable tablet.

8. The press-through pack as set forth in claim 6, wherein said solid material is a dividable tablet.

9. A method of removing tablets, comprising:

placing said press-through pack according to claim 7 on a flat plate, applying an equal force to the plural storage recesses from upward by means of a flat plate placed on said press-through pack in order to divide all dividable tablets contained in each storage recess, and peeling off said sealing sheet from said accommodation body in order to remove plural or all the dividable tablets from said plural storage recesses.

10. A method of removing tablets, comprising:

placing said press-through pack according to claim 8 on a flat plate, applying an equal force to the plural storage recesses from upward by means of a flat plate placed on said press-through pack in order to divide all dividable tablets contained in each storage recess, and peeling off said sealing sheet from said accommodation body in order to remove plural or all the dividable tablets from said plural storage recesses.

11. A press-through pack, comprising:

an accommodation body having plural storage recesses containing solid materials, and a sealing sheet attached to said accommodation body, said sealing sheet adhering to said accommodation body and tightly sealing said storage recesses such that a desired storage recess can be ruptured in order to allow to remove said solid material from said storage recess by pressing an outer surface of a projecting portion corresponding to said storage recess with a finger, and wherein relative strengths of said adhesive layer and said substrate permit integrally peeling and removing said substrate from said accommodation body.

12. The press-through pack as set forth in claim 11, wherein said solid material is a dividable tablet.

13. The press-through pack as set forth in claim 12, wherein the bonding strength of said sealing sheet to said accommodation body is defined in the range from 0.9N/15 mm width to 3.1N/15 mm width when T peeling test of JIS Number K6845 at a peeling speed of 200 mm/min.

14. The press-through pack as set forth in claim 13, wherein the bonding strength of said sealing sheet to said accommodation body is defined in the range from 4.2N/15 mm width to 7.0N/15 mm width when T peeling test of JIS Number K6845 at a peeling speed of 100 mm/min.

15. The press-through pack as set forth in claim 13 or 14, wherein said adhesive layer is partially coated on said sealing sheet.

16. A press-through pack, comprising:

an accommodation body having plural storage recesses provided with sheet portions therebetween, said plural storage recesses containing solid materials within respective projecting portions, and a rupturable sealing sheet having one surface side bearing an adhesive layer, said sealing sheet adhering to said sheet portions so as to tightly seal said storage recesses, wherein relative strengths of said sealing sheet and said adhesive layer permit integrally peeling said sealing sheet from said accommodation body, and also selectively rupturing only portions of said sealing sheet corresponding to individual storage recesses when projecting portions of said recesses opposite said sealing sheet are pushed in the direction of said sealing sheet without partial floating other sheet portions from said accommodation body.

17. The press-through pack as set forth in claim 16, wherein said bonding strength of said sealing sheet to said sheet portion is in the range from 0.9N/15 mm width to 3.1N/15 mm width at a peeling speed of 200 mm/min.

18. The press-through pack as set forth in claim 16, wherein said bonding strength of said sealing sheet to said sheet portion is in the range from 4.2N/15 mm width to 7.0N/15 mm width at a peeling speed of 100 mm/min.

19. The press-through pack as set forth in claims 16–18, wherein said solid material is a dividable tablet.

20. The press-through pack as set forth in claims 16–18, wherein said adhesive layer comprises an adhesion lowering component.

21. The press-through pack as set forth in claim 16, wherein said adhesive layer is partially coated on said sealing sheet.

22. A method of removing tablets, comprising:

placing said press-through pack according to claim 16 on a flat plate, applying an equal force to the plural storage recesses from upward by means of a flat plate placed on said press-through pack in order to divide all dividable tablets contained in each storage recess, and peeling off said sealing sheet from said accommodation body for removing said all dividable tablets from said plural storage recesses.

* * * * *